US005566521A

United States Patent [19]

Andrews et al.

[11] Patent Number: 5,566,521

[45] Date of Patent: Oct. 22, 1996

[54] BUILDING STRUCTURE AND METHOD

[76] Inventors: Richard E. Andrews, 13852 W. 78th Pl., Arvada, Colo. 80005; Mark E. Wilsey, P.O. Box 902, Pagosa Springs, Colo. 81147

[21] Appl. No.: 288,347

[22] Filed: Aug. 10, 1994

[51] Int. Cl.[6] ..... E04B 2/20; E04C 2/10

[52] U.S. Cl. ..... 52/606; 52/309.17; 52/426; 52/597; 52/607

[58] Field of Search ..... 52/309.12, 309.15, 52/309.16, 309.17, 606, 597, 598, 426, 607

[56] References Cited

U.S. PATENT DOCUMENTS

| | | | |
|---|---|---|---|
| 3,788,020 | 1/1974 | Gregori | 52/309.12 |
| 4,233,501 | 9/1980 | DeLozier | 52/309.11 |
| 4,532,745 | 8/1985 | Kinard | 52/251 |
| 4,731,971 | 3/1988 | Terkl | 52/309.12 X |
| 4,823,534 | 4/1989 | Hebinck | 52/743 |
| 4,860,515 | 8/1989 | Browning, Jr. | 52/426 |
| 4,879,855 | 11/1989 | Berrenberg | 52/426 X |
| 4,924,641 | 5/1990 | Gibbar, Jr. | 52/204 |
| 5,014,480 | 5/1991 | Guarriello et al. | 52/309.12 |
| 5,123,222 | 6/1992 | Guarriello et al. | 52/309.12 |

FOREIGN PATENT DOCUMENTS

| | | | |
|---|---|---|---|
| 31171 | 7/1981 | European Pat. Off. | 52/309.17 |
| 2324915 | 12/1974 | Germany | 52/309.12 |
| 2551091 | 5/1977 | Germany | 52/606 |
| 5038892 | 12/1975 | Japan | 52/309.12 |
| 53962 | 1/1943 | Netherlands | 52/606 |
| 7408817 | 1/1976 | Netherlands | 52/309.12 |

*Primary Examiner*—Carl D. Friedman
*Assistant Examiner*—Yvonne Horton-Richardson
*Attorney, Agent, or Firm*—Kyle W. Rost

[57] ABSTRACT

A concrete form mold unit formed of a lightweight, insulative material defines at least two rows of vertical core spaces, offset from each other. Concrete and reinforcing rods fill the core spaces, defining post structures. The top of the form mold unit is troughed and is filled with horizontal reinforcing rods and concrete, defining beam structures. The form mold units are laid in courses and stacked as required to build walls, with vertical cores and horizontal troughs aligned, producing an efficient utilization of concrete in the posts and beams. Each course is filled with concrete before the next course is added. The form mold unit is retained as an insulative part of the building structure, with a low dead load. Vertical attaching plates are placed on the surface of the wall, with penetrating fasteners passing into an underlying concrete post or beam. Surface finish materials are joined to the attaching plates.

23 Claims, 4 Drawing Sheets

BUILDING STRUCTURE AND METHOD

TECHNICAL FIELD

The invention generally relates to static structures such as buildings and the components and processes for constructing a building in an energy efficient manner. More specifically, buildings are constructed of post and beam structures of cast, reinforced cementitious materials such as concrete. The form for the cast material is a low density, insulative material such as expanded polystyrene (EPS) and is left in situ as permanent wall elements.

BACKGROUND ART

The construction art is familiar with techniques and materials for erecting a building of expanded polystyrene (EPS) forms and reinforced concrete posts and beams. Form units are used to form substantially vertical concrete structural elements such as foundations and walls. The vertical form units are laid end to end and stacked atop each other to achieve the desired final configuration for the vertical structure. Uncured concrete is poured into the voids of the forms, forming a concrete post and beam assembly that provides structural strength and integrity. The EPS of the form provides excellent insulation for the finished wall structure.

For example, U.S. Pat. No. 4,223,501 to DeLozier discloses foamed polymeric concrete faces on a form unit which employs transverse metal connectors to support the faces and also to support finish materials. Although the foamed faces remain in place after the concrete is formed, substantially the entire interior of the form unit is filled with concrete, forming a substantially solid, uninterrupted concrete wall.

Somewhat similar art in found in U.S. Pat. No. 4,924,641 to Gibbar, Jr., which discloses polystyrene concrete wall forms made of opposite exterior polystyrene sheets separated by a matrix of polystyrene blocks. The space between blocks defines a lattice work of interior vertical and horizontal voids, which receive reinforcing bar and poured concrete. The forms are held together against bulging and separation, inside and outside, by T-shaped and L-shaped retainers joined by straps.

Another example is found in U.S. Pat. No. 4,823,534 to Hebinck, which proposes a wall structure in which EPS blocks are set on a foundation and serve both as concrete forms and as permanent pans of a building wall. The blocks define laterally spaced apart vertical post forms and, across the top course of the blocks in a wall, a horizontal beam form. Reinforcing rods are placed in the various post and beam forms and subsequently are encased in poured concrete.

Similar wall-forming art is found in U.S. Pat. No. 4,532,745 to Kinard, which adds a discrete channel member across the top of the blocks in each course. This channel member is formed of a material such as wood that can retain nails or screws, so that conventional wall surfaces can be applied in traditional ways.

The use of existing wall-forming art has been limited due to several factors. The ability of these formed concrete walls to resist buckling under vertical loads is a function of width or diameter of the vertical columns and the spacing of the columns. To use existing art for larger structures or with substantially increased loads would demand a significant increase in the amount of concrete consumed. This adversely effects the economics of the system, partially due to the cost of concrete, but largely due to the costs of handling much larger volumes of concrete. A related problem is that when proportionately more concrete is used, as compared to the quantity of EPS, the R-value of the wall system decreases.

Accordingly, there is a need for a concrete forming system in which forms of insulating material meet the design criteria that would demand varying the effective wall width; yet, do not require the cost and labor of using substantially increased quantities of concrete. Further, such a system should not sacrifice the insulation value of the insulating form material.

To achieve the foregoing and other objects and in accordance with the purpose of the present invention, as embodied and broadly described herein, the building structure and method of this invention may comprise the following.

DISCLOSURE OF INVENTION

Against the described background, it is therefore a general object of the invention to provide an improved building structure of the type formed of reinforced concrete, in which the structural posts and beams are sized to efficiently utilize concrete, while excluding concrete from areas where it would constitute mere dead load.

Another object is to provide a building structure and method of construction in which the effective wall width can be varied by changing the relative position of rows of posts, instead of by thickening a wall and increasing dead load.

A related object is to provide an efficient and reliable structure and method for attaching finish materials to walls composed of a low density, synthetic material such as EPS.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a building structure is constructed of a building block having opposite faces, formed of a synthetic material having a predetermined low density and predetermined high thermal resistance. The block defines a plurality of approximately vertical core spaces extending between top and bottom surfaces of the block and arranged in at least two core space rows running approximately parallel to one of said faces of the block. The core space rows are offset from each other such that each core space row is spaced from the block face by a different distance.

According to the method of the invention, a building wall structure of low dead load is formed by providing a concrete form mold unit of a lightweight, insulative, synthetic material having a predetermined density lower than concrete and a predetermined thermal resistance higher than concrete, having a plurality of approximately vertical core spaces extending between top and bottom surfaces of the mold unit and arranged in at least two core space rows laterally offset from each other and running approximately parallel to each other and between opposite ends of the mold unit. A plurality of the concrete form mold units are arranged in end-to-end relationship to define a course. A plurality of core rods of predetermined high tensile strength similar to concrete reinforcing rod are arranged in the core spaces, with at least one core rod being located in substantially each core space. The core spaces are filled with wet cementitious material similar to concrete. Thereafter, the wet cementitious material is allowed to cure, thereby forming a building wall structure of two offset rows of reinforced cementitious posts, with the synthetic material intermediate the posts providing low dead load. The concrete form mold unit is retained as pan of the building wall structure.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

Figure 1:
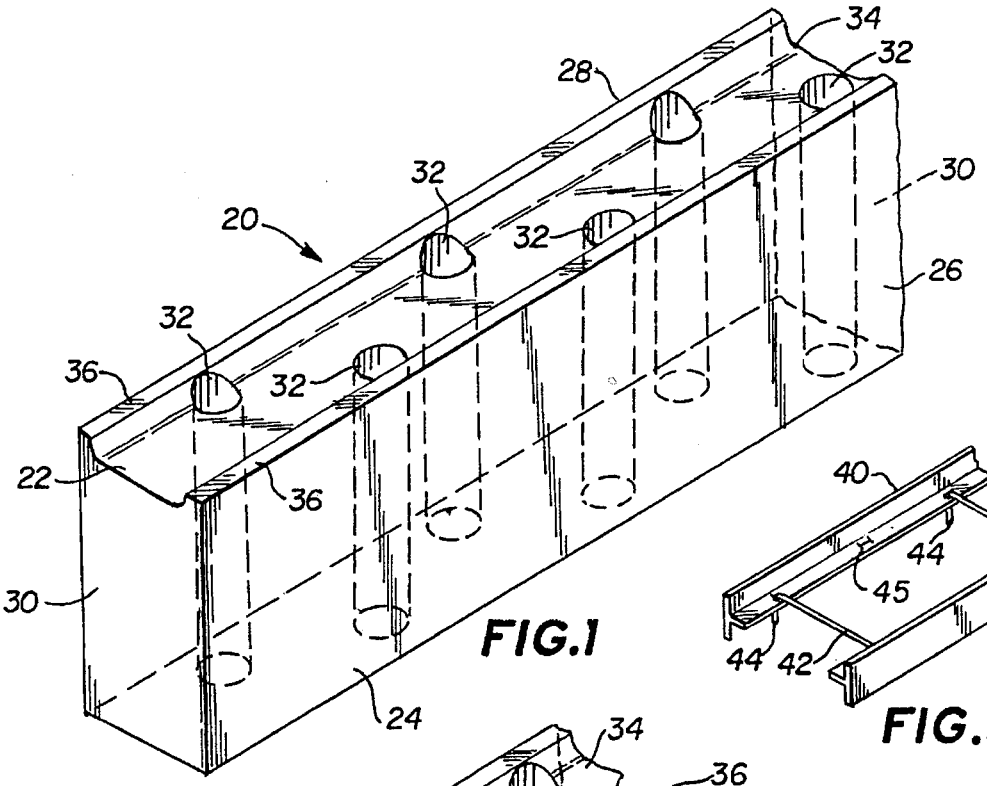
FIG. 1 is an isometric view of a concrete form block unit, showing a representative arrangement of core spaces, with interior structures shown in phantom.

The invention is an improved concrete form block unit, the building structure defined by use of such a unit, and the method of assembling such structures. The form block unit is constructed of any suitable insulative material and is preferred to be light weight and of low density as compared to concrete or wood. When the terms, "low density" or "light weight," are used in connection with the insulative material, they especially refer to density of about 1 to 2½ lb/cu. ft. or less. More specifically, these terms may refer to materials having insulative characteristics similar to or better than expanded polystyrene (EPS). However, the insulative material is not required to have the same strength characteristics as the materials that have been used in the past, typically EPS, since the amount of concrete placed in the form block is minimal. Throughout the disclosure, the insulative material will be referred to as EPS, which is the presently preferred material, with the understanding that other materials may be used within the scope of the invention. The shape of the form block unit is self-supporting when used to construct a steel reinforced concrete post and beam wall structure.

The form block unit defines a plurality of vertical core elements, i.e., holes or voids, that receive wet, curable construction material such as concrete, to be cured as posts or columns. Of particular advantage is that the posts can be minimally sized and placed at the outer edge of the form block unit, rather than at the center as commonly practiced in the prior art. The form block unit confines the concrete to variably spaced vertical columns. Although the columns might be of any shape of size, for greatest efficiency the cores or voids of the form blocks typically are round and of the smallest diameter feasible to easily accept the concrete mix. Reinforcing material such as steel reinforcing rod is placed in the vertical cores with the wet concrete. Placing compressive and tensile members, i.e., steel reinforcing bar (rebar) and concrete, farthest from the center line of the block maximizes efficiency of these materials. Thus, the posts are offset from the center of the block. Wall strength is increased by increasing the offset, rather than by increasing the amount of concrete. This construction technique can eliminate the need for structural pilasters, as well. Further, the use of minimally sized columns or posts requires reduced amounts of concrete, as compared to the prior art, to achieve any desired structural criteria. Often the quantity of concrete is sufficiently small that batches can be mixed on the job site, rather than requiring loads brought in by truck and pumped. However, one of the most significant advantages is that structures can be designed with greater cost effectiveness, since the wall itself will create only minimal dead load.

Optionally, the top of the form block has a concave shaped trough running its length. This trough is slightly narrower in width than the outside dimension of the form and spans the vertical core elements. Horizontal reinforcement is placed in this trough, which also is filled with concrete. The concrete and rebar in the horizontal trough are in communication with the concrete and rebar in the vertical cores, which creates an integral reinforced concrete post and beam structure. Further, the trough serves as a funnel, directing the flow of wet concrete into the vertical cores during filling.

Figure 2:
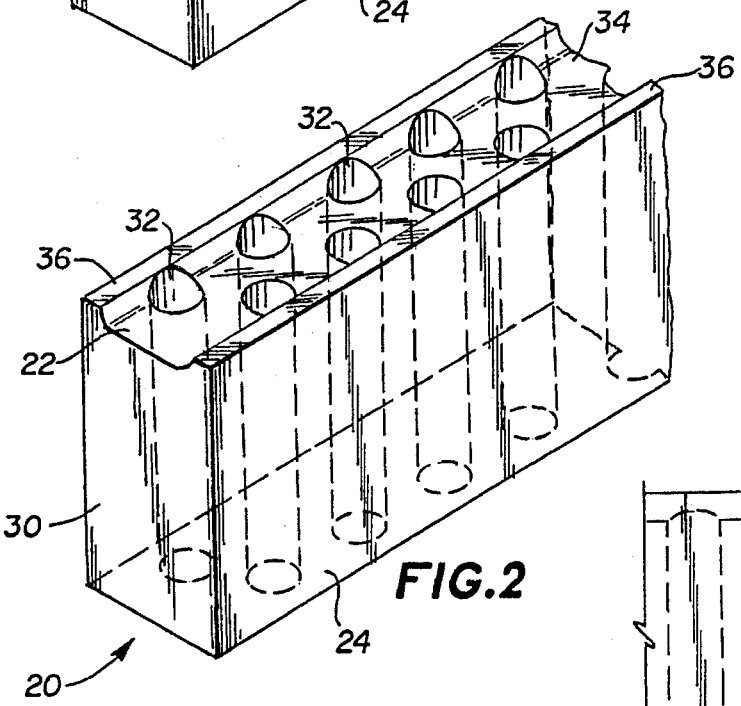
FIG. 2 is a view similar to FIG. 1 of a partial form block unit, showing a modified arrangement of core spaces.
Figure 3:
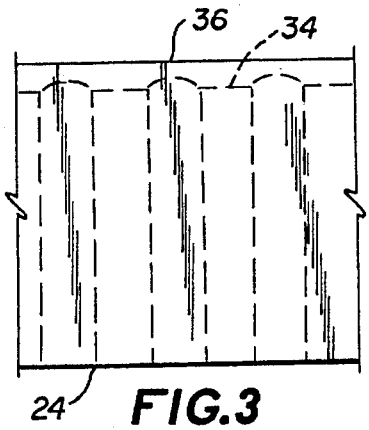
FIG. 3 is a front elevational view of a portion of the form block unit of Figure 2, showing interior structures in phantom.

In greater detail, and with reference to the FIGS. 1–3 of the drawings, the invention is a building structure employing lightweight, insulative concrete form mold unit that remains a part of the building. The forms or blocks are configured to be substantially serf-supporting during the construction process, when wet concrete or like flowable construction material is placed in the forms. In the example shown in FIG. 1, a building block 20 is formed of a synthetic material having a predetermined low density and predetermined high thermal resistance. The block is longitudinally elongated and can have any desired length but typically will be either sixteen or twenty- four feet in length. Similarly, the block can have any height, but typically the height will be four feet. The thickness or width of the block is a matter of design, dependent upon the structural load and insulative requirements of the block. In a basic embodiment, this width might be sixteen inches. It is preferred that contiguous units in a structure be of the same width to form integral side by said and end to end assembly. Other details of block structure are conventionally defined: there is a top surface 22, bottom surface 24, outside face 26, inside face 28, and opposite end surfaces 30.

Such a block 20 may be formed from expanded polystyrene and, thus, bears the density and thermal resistance of EPS. Other materials may be used, as well. Typical density is from one to two and one-half pounds per cubic foot, although still less dense materials might be suitable. Blocks of these low density materials are easily handled without the need for cranes or heavy equipment, They can be cut to any size or shape at the job site by any number of means. For example, an electric hot wire or saw can be used on EPS or similar form materials.

The block 20 defines a plurality of core spaces 32 extending between top and bottom surfaces of the block and arranged in at least two core space rows. The rows typically are approximately parallel to each other and to the faces of the block. The core space rows are offset from each other such that each core space row is spaced by a different distance from one of the block faces, such as from the outside face 26. If the block is viewed as having a longitudinal center line or longitudinal, vertical center plane, typically the core space rows will be offset at least partially on opposite sides of such a center line or center plane, such that the two rows can be referred to as the inside row and the outside row, juxtaposed, respectively, to the inside and outside faces of the block. Also typically, the outside row will be spaced from the outside face of the block by a small distance, which is the same distance by which the inside row is spaced from the inside face of the block.

The spacing and position of each core space and of the core space rows are subject to variation according to design specifications. For example, in FIG. 1 the core spaces 32 are relatively more widely spaced along the length of the block, while in FIG. 2 they are more narrowly spaced along the length. Thus, the block of Figure 2 has more core spaces per unit of length and will produce posts or columns in a more closely spaced array. Significantly, the core spaces in both of these figures are about of the same diameter, such as four inches. The diameter is chosen to maximize effective use of concrete and rebar, while minimizing dead load.

A second way of varying spacing and position of the core spaces is by changing the offset of the two core space rows. In almost every case, this is accomplished by changing the width of the block, instead of by changing the relative separation of the rows within a block of fixed width. Each row is preferred to be at the maximum possible offset, closely adjacent to a different one of the opposite block faces. The maximum separation within a predetermined block width is limited because the core space must be supported by a sufficient wall width of EPS to bear the load of the wet concrete, and this wall thickness sets a limit on the practical closeness of each row to the nearest face of the block. In addition, wall thickness must be sufficient to meet the requirements for covering wiring under the National Electrical Code. The preferred minimum wall thickness is about one and one-half inches in a core space four feet high and four inches in diameter. Thus, with these dimensions, the wall of each core space is at a minimum distance of about one and one-half inches from the nearest block face. There is little or no practical reason to space the rows further than the minimum distance from a block face. When the spacing between rows is to be increased by a predetermined amount, the width of the block is increased by the preselected amount, and the core space rows maintain their closeness to the nearest block faces. More than two rows of core spaces can be employed when the block width is great enough to accommodate them. Thus, the two ways to altering core space design are by changing the closeness of cores in a longitudinal row and by changing the width of a block, correspondingly changing the lateral offset of the rows. As an optional feature, the top surface 22 of each block 20 may define a longitudinally extending trough 34 laterally bounded by a pair of opposite lips 36 along the edges at the inside and outside faces of the block. The trough is continuous along the length of the block so that it will extend unbroken along a course of blocks laid end to end. A preferred design employs a lip 36 of the same width as the minimum wall thickness of a core space, such as one and one-half inches. Thus, the core spaces will be tangent to the lip at the top of the block, and the trough, itself, is in communication with the top end of all of the core spaces. The depth of the trough is the minimum thickness of a beam for effective use of concrete while minimizing dead load. About three-quarters inch of cover is desired, which might produce a trough depth of two to two and one-quarter inches for steel reinforced concrete. While it would be possible to utilize two or more parallel troughs in a single block, corresponding to the positions of the core space rows, the use of a single trough is preferred for practical use of the trough to serve as a funnel while filing the core spaces with concrete. Thus, a trough will be about thirteen inches wide in a typical application with a sixteen inch block width.

Figure 4:
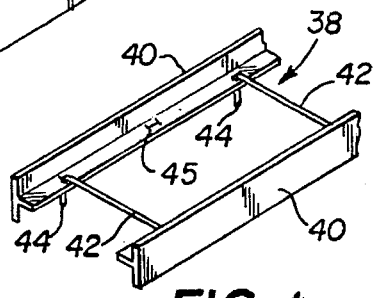
FIG. 4 is an isometric view of an alignment member.

The concrete form mold unit 20 is used to construct the wall portion of a building structure. With reference to FIG. 4, the blocks 20 are laid in courses and stacked to the desired height, using alignment members 38 between courses. The alignment members include single channel or double channel retainers. Double channel, or T-shaped retainers 40, as shown in FIG. 4, are used between two courses. Each retainer 40 has a web portion that is sandwiched between the courses, while a surface plate or flange portion borders the face of the blocks and holds the courses in vertical alignment. The web supports the alignment member at the level of the course and provides an attachment for joining straps 42, placed transversely across the wall. The joining straps each have a central shank portion with its ends formed as normally disposed piercing hooks that can pass through the web, which is provided with holes to receive the hooked ends 44 of the straps. The web may be formed of a resilient material, with each hole defined by an H-shaped perforation 45 through the web. The cross-bar of the H-shaped perforation defines the penetration point for the strap end, while two opposite ears defined by the remainder of the perforation serve as friction locks that hold the strap in place. At the top and bottom of a wall, a single or L-shaped retainer 46, FIG. 5, may be used, which is only the top or bottom half of the retainer 40 of FIG. 4. Such a single channel retainer 46, having a flange extending in only one direction from the web, is used whenever it is desired that an unused opposite half of the flange is not present. Typically the single channel retainer is used immediately above a footer or on top of the last course of block.

Figure 6:
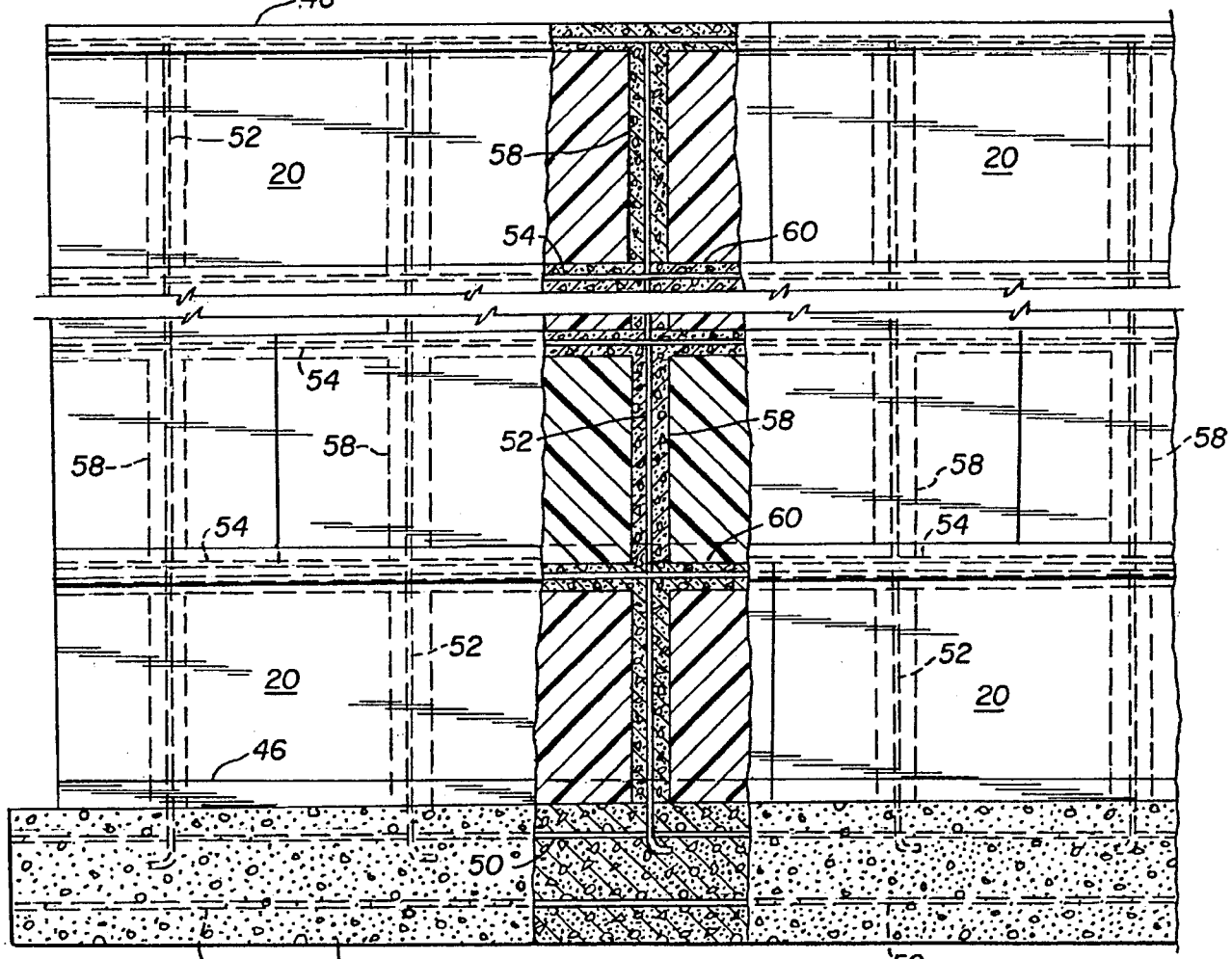
FIG. 6 is a front elevational view of the wall structure of FIG. 5, showing interior structure in phantom.
Figure 5:
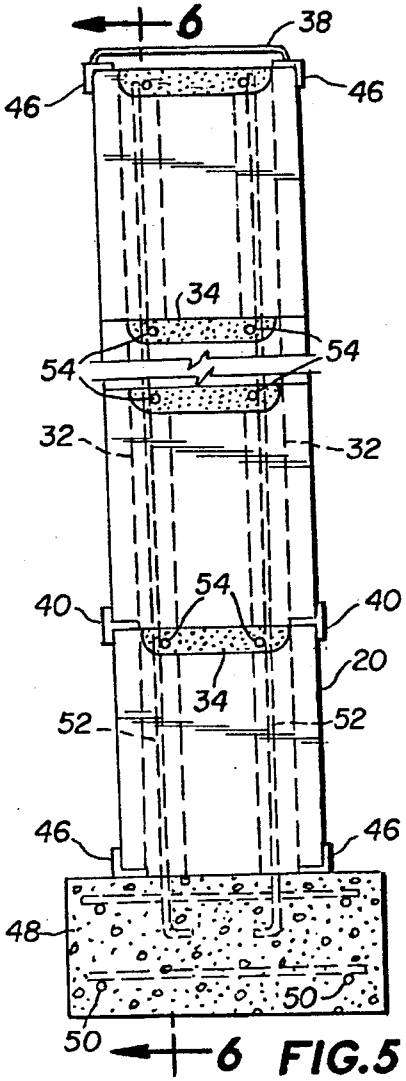
FIG. 5 an end elevational view of a wall structure formed of the form block units, showing interior structure in phantom.

A building structure formed of courses of the form block unit is shown in FIG. 5 and 6, which also illustrates the method of construction. Each wall is provided with a suitable foundation or footer 48 constructed in accordance with local codes. The foundation or footing may be of concrete poured over horizontal rebar 50. A plurality of core rods 52 of predetermined high tensile strength similar to concrete reinforcing rod is embedded in the footer. This vertical core rebar 52 is placed in the wet concrete and is left protruding upwardly from the footing. The protruding length of the rebar 52 is of at least the height of the concrete form block unit 20 plus at least the minimum code lap requirement for rebar. The spacing or layout of the rebar is such that it corresponds and aligns with the spacing of the cores in the form block unit, with at least one core rod 52 being located in position to be received in substantially each core space.

An alignment member having single channel retainer 46 is placed on the footer, and a bottom form block unit 20 is lowered over the properly spaced rebar 52 and accepted into the single channel alignment member. The vertical core rod 52 is received through the each of the core spaces 32 and through the height of the top trough and should be approximately centered in each core space. In the same manner, the remainder of the first course is laid with additional blocks. After the first course of form block units is in place and suitably braced in plumb posture, at least one trough rod 54 of predetermined high tensile strength similar to concrete reinforcing rod is positioned in the vertical center of the first course trough 34 by attaching rebar 54 to vertical core rods 52 in the core spaces. The trough rod is in direct communication with at least some, and preferably all of the core rods. It is preferred that at least two trough rods 54 are located in the top trough, and each of these rods 54 is in direct communication with the core rods in a different one of said core space rows.

With the rebar in place, wet concrete is poured into the trough and core spaces, using the trough as a funnel. Sufficient concrete is added to substantially fill the vertical cores and the horizontal trough, embedding the core rod and trough rod in concrete, except for the residual ends of the core rod, which protrude for overlap with rod of the next course. Although concrete is a preferred and readily available material, other flowable construction material such as cementitious material of predetermined high density and compressive strength similar to concrete can be used. Such materials are referred to as concrete, since concrete is the presently preferred material. The concrete is allowed to cure for a sufficient time to support successive courses.

The next course is added by first placing alignment members 38 with double channel retainers 40 across the top of the first course. The form block units 20 are placed in the alignment members and longitudinally staggered so that the block ends are offset from those of the underlying course. However, the core spaces 32 of the new course are aligned with the underlying core spaces and receive the residual end portions of the underlying core rods from the first course. If required to obtain enough rod length to pass through the new course, new core rods 52 are placed in each core space and overlap the residual ends of the underlying rods at the bottom of the second course blocks. Further, the new rods are of sufficient length to protrude from the top of the second course blocks by at least the code lap requirement for rebar. With increasing building height, the upper courses may require fewer cores and, correspondingly, fewer posts. Those cores that will continue to form posts in the upper courses are aligned with the lower cores, as described. Other posts may terminate at a specified course and have above the termination point either empty cores spaces; or the upper course blocks may be formed without certain of the core spaces.

Figure 9:
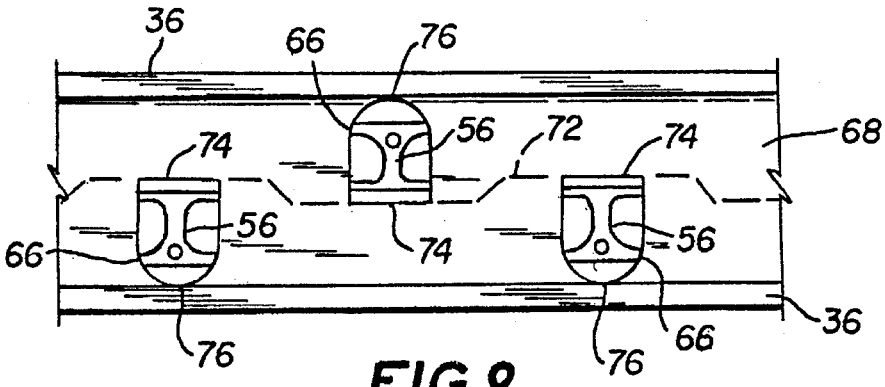
FIG. 9 is a top plan view of a modified form unit, showing an alternate structure of core spaces.

To aid the new core rods 52 in maintaining communication with the underlying core rods, the new core rods may carry centering spacers that approximately center the rebar in the core space. One such spacer is shown in FIG. 9 as spacer 56. The shape of the spacer may be adapted to the cross-section shape of the core space. Two lengths of overlapped rebar will be deemed to be in communication with each other if they are at least in close proximity to each other, such as by passing within about one inch of each other. With the vertical core rods in place, the trough rod is put in place, and wet concrete is poured into the cote spaces and trough, embedding the core rod and trough rod, except for the residual upper ends of rod above the top of the trough. This process is repeated as necessary to obtain the desired wall height. The top course will be capped by alignment members 38 having single channel retainers 46.

With reference to FIG. 6, the completed rough wall will consist of steel reinforced concrete posts 58 and steel reinforced concrete beams 60 forming an interconnected support structure for a building. Substantially all volume in the wall that is not necessary or an effective part of the post and beam structure is formed of the EPS block 20, with the result that the dead load of the wall is extremely small. However, the EPS creates a super insulated wall structure is well suited to receive finish materials on its outside and inside faces.

Figure 7:
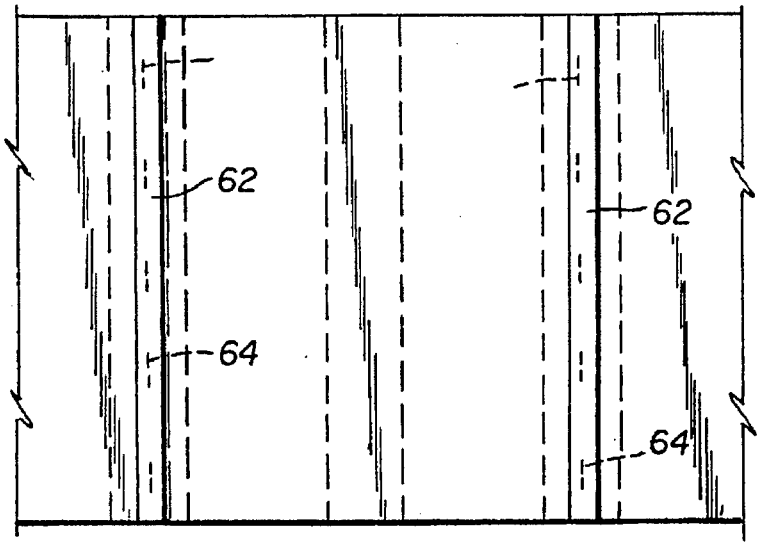
FIG. 7 is a front elevational view of a partial wall structure, showing attaching structures for surface finish materials and showing interior structure in phantom.
Figure 8:
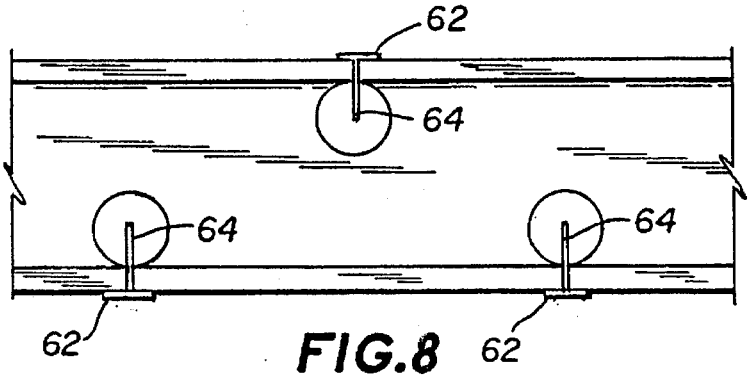
FIG. 8 is a top plan view of the wall structure of FIG. 7.

Finish materials can be attached to a rough wall by many techniques. Although EPS does not retain nails or like fasteners well, the core posts 58 will anchor such fasteners, particularly before the concrete is fully cured. While the concrete is green, the posts can be used to anchor attaching plates, which will receive conventional fasteners at a later time when interior or exterior finishes are being applied. With reference to FIGS. 7 and 8, a vertically elongated attaching plate 62 is set against tile outside face and inside face of a block or wall in a position overlying one of the core spaces 32 of a core space row juxtaposed to the face. The attaching plate 62 is a fiat strip of metal, wood, or plastic having a suitable width, such as one and one-half inches, to serve as a target for nails or screws used to attach drywall, siding, or the like. An elongated fastener 64, such as a nail, is carried by the attaching plate at one end thereof and passes into the core space overlaid by the attaching plate. It is preferred that the attaching plate have integral fasteners 64 with barbed ends. If the attaching plate is applied to a wall after the concrete is in place, the uncured or green concrete in the core space will receive the barbed end of the fastener and firmly retain it. Alternatively, the attaching plate can be applied to a wall before the concrete is poured, with the result that the fastener is attached after the concrete is poured. Still another way mounting the attaching plate is by molding the plate to the block in the block forming process. The attaching plate, in turn., is a suitable anchor for receiving and retaining the nails or screws that hold drywall or siding in place. Alternatively, finish materials may be bonded to file EPS wall or, preferably, to the attaching plates 62. During wall construction, the attaching plates will be applied to the wall shortly after the wall is erected, while the concrete remains green. Finish material can be applied at any later time.

As thus far described, the blocks 20 define core spaces that are cylindrical, producing cylindrical posts. Other shapes may be used without departing from the scope of the invention. In particular, with reference to FIG. 9, a D-shaped core 66 is employed in the manufacture of half blocks 68. Each half block is formed in the same or similar mold, or extruded, or cut from a bulk log of EPS, to have substantially an identical shape, similar to that of a block 20 divided along a central, vertical, longitudinal plane. Thus, each half block has an outside face, two opposite end surfaces, a bottom, and a top that defines approximately a half trough, all as previously shown and described. Opposite the outside face is a joining face 72, which is shown as a common joining line between two half blocks in the view of FIG. 9.

The D-shaped core has an approximately straight edge 74 parallel with the joining face 72, while the curved portion 76 is tangent to the trough lip. One advantage of the D-shaped core is that the width of core, from straight edge 74 to tangent 76, is variable according to the required width of the finished block. Each half block is formed with about half the required width, and two half-blocks are united to form a finished block. The joining line 72 may be straight, although a zig-zagged line as shown in the drawing can be useful to adjust the width of each core regardless of the overall width of the finished block. A particular advantage of the D-shaped cores is that each core is laterally exposed at the joining line prior to assembly of a finished block. This allows the entire half-block and core spaces to be formed with a hot-wire EPS cutter from a bulk log of EPS. Thus, finished blocks can be formed by bonding together or otherwise joining two half blocks. This work can be performed at the building site, without the need for molds, by supplying logs of EPS and suitable cutting and bonding equipment.

Figure 10:
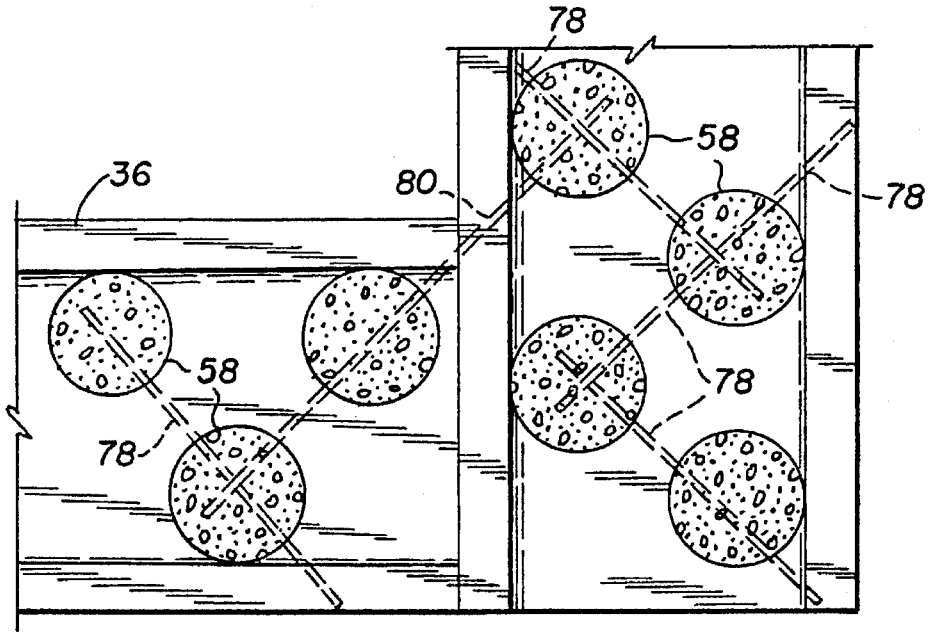
FIG. 10 is a top plan view of a corner wall structure, showing in phantom the arrangement of reinforcing bars.
Figure 11:
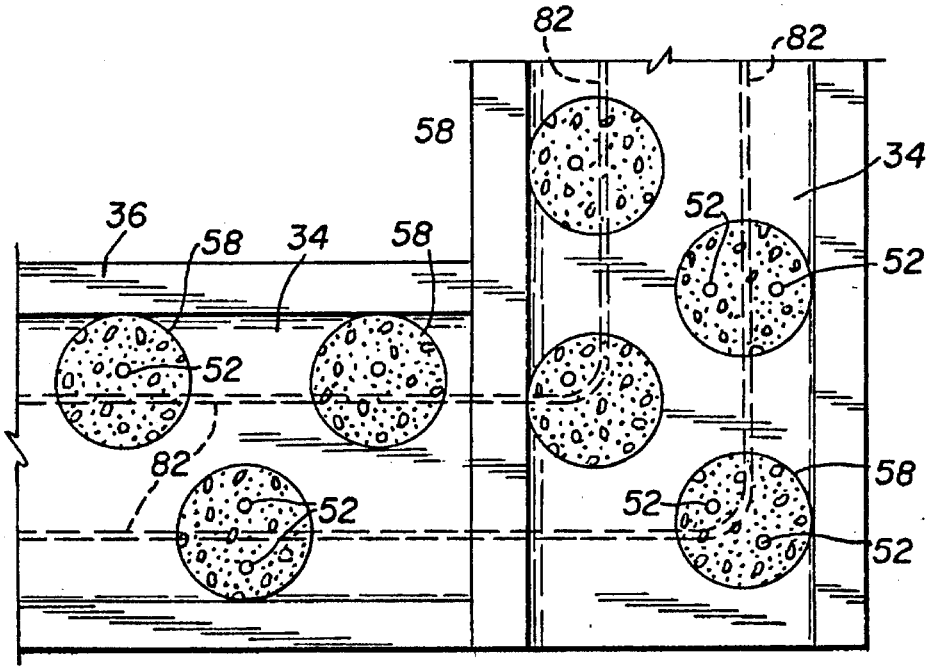
FIG. 11 is a view similar to FIG. 10, showing in phantom an alternative arrangement of reinforcement bars.

The posts 58 formed in cores of any cross-sectional shape can be linked together to reinforce and brace the building structure. FIG. 10 shows a corner of two walls formed of blocks 20. Posts 58 are tied together by lateral rebar, placed through two or more core spaces before concrete filler is added. The reinforcing rods 78 are pushed trough the EPS material of a single block at a suitable angle to penetrate and tie together two posts within the same block. Rebar 80 spans two blocks at the corner, penetrating three or more posts. Another joining and reinforcing technique is shown in FIG. 11, in which trough rebar 82 is bent at a corner and placed in a troughs 34, configured to run continuously around the comer. These trough rebar are tied to or in close proximity to vertical rebar 52, so as to be in communication with the vertical rebar. Reinforcement by linking posts and beams with rebar can be used within a block, between blocks, across and around corners, between any posts or beams or combinations of posts and beams, in walls, in floors, in roofs, and in combinations of such structures.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

We claim:

1. A building structure, comprising:

a building block having opposite faces, formed of a synthetic material having a predetermined low density and predetermined high thermal resistance; wherein:

said block defines a plurality of approximately vertical core spaces extending between top and bottom surfaces of the block and arranged in at least two core space rows running approximately parallel to a predetermined face of the block;

said core space rows are offset from each other such that each core space row is spaced from said predetermined face by a different distance; and the top surface of the block defines a top trough in communication with one end of said core spaces;

a cementitious material substantially filling said core spaces and top trough;

a plurality of core rods of predetermined high tensile strength similar to concrete reinforcing rod, embedded in said cementitious material in said core spaces, with at least one core rod being located in substantially each core space; and at least one trough rod of predetermined high tensile strength similar to concrete reinforcing rod being located in the top trough.

2. The building structure of claim 1, wherein:

at least some of said core rods extend into said top trough.

3. The building structure of claim 1, wherein said trough rod is in direct communication with at least some of said core rods.

4. The building structure of claim 1, wherein at least two trough rods are embedded in said top trough, and each of said rods is in direct communication with a core rod in a different one of said core space rows.

5. The building structure of claim 1, wherein:

said opposite faces of said building block comprise an outside face and an inside face;

one of said core space rows is juxtaposed to said outside face; and another of said core space rows is juxtaposed to said inside face.

6. The building structure of claim 5, further comprising a vertically elongated attaching plate set against a face of said block in a position overlying one of said core spaces of a core space row juxtaposed to said face.

7. The building structure of claim 6, further comprising an elongated fastener attached to said attaching plate at one end thereof and passing into said overlaid core space.

8. The building structure of claim 1, wherein said core rod is substantially in the center of said core space.

9. The building structure of claim 1, wherein said core spaces are substantially cylindrical.

10. The building structure of claim 1, wherein:

said building block is formed of at least two sub-portions, each including one of said faces and having a mating surface opposite the face;

each sub-portion of the block defines at least one core space extending between top and bottom surfaces of the block and having an open side in the mating surface of its respective sub-portion;

the sub-portions of the block are joined at the mating surfaces to form the block; and the core spaces are positioned in their respective sub-portion such that when the sub-portions are in joined configuration, the mating surface of each sub-portion closes the open side of a core space in the other sub-portion.

11. The building structure of claim 10, wherein:

each of said sub-portions comprises approximately one-half of said block.

12. The building structure of claim 11, wherein:

each of said sub-portions is substantially identical in configuration.

13. The building structure of claim 10 wherein:

said mating surfaces are bonded together.

14. The building structure of claim 10, wherein said core spaces are approximately D-shaped in horizontal cross-section; and the flat side of the "D" shape lies in said mating surface.

15. The building structure of claim 1, further comprising:

spacer means for supporting said core rods in said core spaces in a position spaced from the walls of the core spaces.

16. The building structure of claim 1, further comprising:

a plurality of said building blocks in vertically stacked arrangement, with their core spaces vertically aligned;

said cementitious material of predetermined high density and compressive strength similar to concrete substantially filling said vertically aligned core spaces; and said plurality of core rods of predetermined high tensile strength similar to concrete reinforcing rod being embedded in said cementitious material in said core spaces, with at least one core rod being located in substantially each core space and core rods in vertically aligned core spaces being in direct communication.

17. The building structure of claim 1, further comprising:

a plurality of said building blocks set in substantially horizontal courses with their top troughs in horizontal alignment;

said cementitious material of predetermined high density and compressive strength similar to concrete substantially filling said horizontally aligned top troughs; and a plurality of said trough rods of predetermined high tensile strength similar to concrete reinforcing rod being embedded in said cementitious material in the top troughs, with at least one trough rod being located in each trough, and trough rods in horizontally aligned top troughs being in direct communication.

18. The building structure of claim 17, wherein a plurality of courses are stacked in vertical alignment, further comprising:

a course joining member formed of a surface plate and a central web defining a T-shaped cross-section, wherein said surface plate overlaps the junction of two courses of said building blocks, and said central web is interposed between stacked courses the building blocks at their junction.

19. The building structure of claim 18, wherein:

two course joining members are disposed with one of said course joining member at the inside faces of said blocks and the other course joining member at the outside faces of the blocks at the junction of two courses; and further comprising:

a tying member having a shank portion extending between the two course joining members and having a normally disposed piercing end portion on each respective end of said shank, one respective piercing portion passing through a respective one of the opposite central webs.

20. The building structure of claim 19, wherein:

said central webs define H-shaped slits at spaced intervals along their lengths; and a respective one of said piercing end portions is received in an H-shaped slit of each respective central web.

21. The method of forming a building wall structure of low dead load, comprising:

forming a concrete form mold unit of a lightweight, insulative, synthetic material having a predetermined density lower than concrete and a predetermined thermal resistance higher than concrete, having a plurality of approximately vertical core spaces extending between top and bottom surfaces of the mold unit and arranged in at least two core space rows laterally offset from each other and running approximately parallel to each other and between opposite ends of the mold unit, and having a top trough extending between opposite ends of the mold unit;

arranging a plurality of said concrete form mold units in end-to-end relationship to define a course;

providing a plurality of core rods of predetermined high tensile strength similar to concrete reinforcing rod in said core spaces, with at least one core rod being located in substantially each core space;

providing at least one trough rod of predetermined high tensile strength similar to concrete reinforcing rod in said top trough, overlying a plurality of said core spaces, and in contact with a plurality of said core rods;

filling the core spaces and top trough with wet cementitious material similar to concrete;

allowing said wet cementitious material to cure, thereby forming a building wall structure of two offset rows of reinforced cementitious posts and a reinforced cementitious top beam, with said synthetic material intermediate the posts providing low dead load; and retaining said concrete form mold unit as part of the building wall structure.

22. The method of claim 21, further comprising:

prior to filling the core spaces with cementitous material, spacing said core rods within the core spaces such that the core rods are offset from the walls of the core spaces.

23. The method of claim 21, further comprising:

providing an attaching plate for carrying surface finish materials;

locating said attaching plate against a face of said form mold unit in substantially vertical position, overlying one of said core spaces; and securing the attaching plate to the form mold unit by piercing the form mold unit and wall of said core space with an elongated fastener also joined to the attaching plate.

* * * * *